US009565881B2

(12) United States Patent
Lockyer

(10) Patent No.: US 9,565,881 B2
(45) Date of Patent: Feb. 14, 2017

(54) BAND LENGTH ALTERING DEVICE

(71) Applicant: Bruce A. Lockyer, Langhorne, PA (US)

(72) Inventor: Bruce A. Lockyer, Langhorne, PA (US)

( * ) Notice: Subject to any disclaimer, the term of this patent is extended or adjusted under 35 U.S.C. 154(b) by 0 days.

(21) Appl. No.: 14/735,626

(22) Filed: Jun. 10, 2015

(65) Prior Publication Data

US 2016/0360812 A1 Dec. 15, 2016

(51) Int. Cl.
*A41F 15/00* (2006.01)
*A44B 13/00* (2006.01)

(52) U.S. Cl.
CPC ..... *A41F 15/002* (2013.01); *A44B 13/00* (2013.01)

(58) Field of Classification Search
CPC ..... A41F 1/006; A41F 1/00; A41F 15/00; A41F 15/007
USPC ..... 2/310–312, 322, 323, 325, 338, 336; 450/82, 58, 79, 77, 86, 1, 80
See application file for complete search history.

(56) References Cited

U.S. PATENT DOCUMENTS 2,602,929 A * 7/1952 Chasinov ..... A41F 1/006 2/325
2,653,323 A * 9/1953 Ganim ..... A41F 1/006 2/323
2,668,954 A * 2/1954 Frohlich ..... A41F 1/00 2/323
2,736,899 A * 3/1956 Ayres ..... A41F 1/006 2/323
2,738,509 A * 3/1956 Bauder ..... A41F 1/006 2/325
3,076,463 A 2/1963 Vorsteher
3,191,603 A 6/1965 Marino
4,564,983 A 1/1986 Saito
4,795,400 A * 1/1989 Greenberg ..... A41F 15/007 2/268
6,123,601 A * 9/2000 Hildebrandt ..... A41F 1/006 24/306
6,431,947 B1 8/2002 Henz
6,520,832 B2 * 2/2003 Devita ..... A41F 1/006 2/251
7,232,359 B1 6/2007 Richardson
8,408,964 B1 4/2013 Acker et al.
2006/0094334 A1 5/2006 Davis et al.
(Continued)

FOREIGN PATENT DOCUMENTS

EP 2196101 6/2010
KR 20-0386513 Y1 6/2005
KR 20-424819 Y1 8/2006

OTHER PUBLICATIONS

"Bra Rescue" Online Product Page, Available at least as a Mar. 11, 2015.

(Continued)

*Primary Examiner* — Gloria Hale
(74) *Attorney, Agent, or Firm* — Howard IP Law Group

(57) ABSTRACT

A device for altering the length of an undergarment band assembly includes an elongated body having a first band retaining loop arranged at a first end of the body, and a second band retaining loop arranged at a second end of the body. A first fastening element is arranged proximate the first end of the body and is configured to engage with a second band fastener of a second band of the undergarment band assembly. A second fastening element is arranged proximate the second end of the body and is configured to engage with a first band fastener of a first band of the undergarment band assembly.

20 Claims, 7 Drawing Sheets

(56) References Cited

U.S. PATENT DOCUMENTS

2011/0269376 A1* 11/2011 Clim ..... A41F 15/00
450/86
2012/0174438 A1 7/2012 Aveni

OTHER PUBLICATIONS

International Search Report from related International Application No. PCT/US20116/036981, dated Dec. 5, 2016.

* cited by examiner

BAND LENGTH ALTERING DEVICE

FIELD OF THE INVENTION

The present invention relates to devices configured for attachment to wearable articles, such as adjustable bands of undergarments, for adjusting a girth or circumference of their original range or length.

BACKGROUND

Many consumer products, including wearable garments, use adjustable fastening systems for altering the size and/or fit of an item. Fastening systems used in undergarments, such as brassieres, include slideable adjusters for altering the length of their shoulder straps, as well as "hook and loop" or "hook and eye" type complementary fasteners implemented on the detachable back bands of the undergarments for adjusting their overall girth. FIG. 1 is an illustration of an exemplary undergarment or brassiere 10 having the above-described characteristics. As shown, undergarment 10 generally comprises two adjustable shoulder strap assemblies 11. Each strap assembly 11 comprises an adjustable strap 12 connected to a respective cup assembly 13 and a respective first and second back or rear band 20,22, and is configured to traverse the shoulder of the wearer. First back band 20 and second back band 22 are each attached at one end to a respective cup assembly 13, and are configured to removably attach to one another at respective opposite free ends 21,23. In the exemplary embodiment, end 23 includes a plurality (e.g. two) of hooks 25 for selectively engaging with a corresponding plurality of eyes or loops 27 arranged on end 21 of back band 20 in a conventional manner.

FIG. 2 provides a more detailed view of an exemplary back band "hook and eye" fastening arrangement, such as that illustrated in FIG. 1. As shown, a plurality of rows of eyes 27 may be arranged at varying distances along a longitudinal direction of end 21 of band 20. Eyes 27 are configured to selectably engage with hooks 25 arranged on end 23 of band 22. In this way, a range of adjustment of the overall band length, and thus the overall girth of an undergarment, is realized. In the illustrated embodiment, this range of adjustment consists of a smallest girth setting A, and a largest girth setting B, as well as two intermediate girth settings, for providing a total range of adjustment Z.

While the range of girth adjustment provided by the above-described arrangement may be sufficient for a wearer, any number of factors may contribute to the need for an expanded adjustment range. For example, weight loss or weight gain, and/or the stretching or shrinking of material, may lead to a garment which does not, or no longer, provides ideal fitment. In these instances, a wearer is faced with having to purchase another undergarment of a more suitable size, or find a solution to alter its girth beyond the original adjustment range (Z).

Alternative systems for quickly and economically expanding the adjustment range of these types of garments would be advantageous.

SUMMARY

A device for altering the length of an undergarment band assembly is provided. The device includes an elongated body having a first band retaining loop arranged at a first end of the body, and a second band retaining loop arranged at a second end of the body. A first fastening element is arranged proximate the first end of the body and is configured to engage with a second band fastener of a second band of the undergarment band assembly. A second fastening element is arranged proximate the second end of the body and is configured to engage with a first band fastener of a first band of the undergarment band assembly.

A method of connecting a first band of an undergarment to a second band of an undergarment with a device for altering the girth of undergarment is also provided. The method generally includes inserting the first band of the undergarment through one of a first or a second band retaining loop arranged on the device, and attaching a first fastener of the first band to a second fastening element arranged proximate a second end of the device. A second band of the undergarment is inserted through the other one of the first or the second band retaining loop arranged on the device, and a second fastener of the second band is attached to a first fastening element arranged proximate a first end of the device.

DETAILED DESCRIPTION

Figure 1:
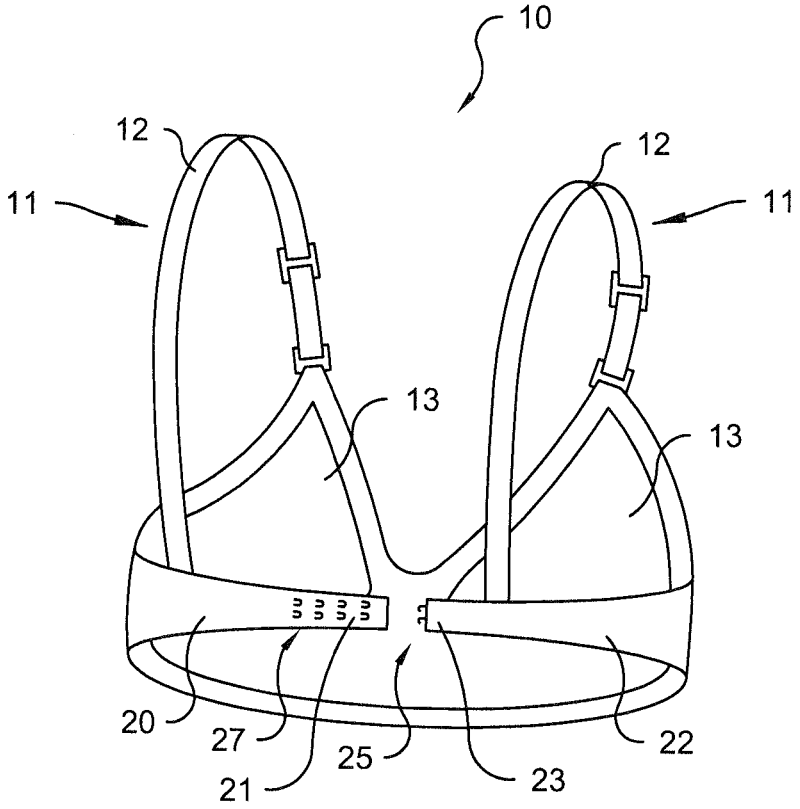
Fig. 1 (Prior Art)
FIG. 1 is an illustration of an exemplary undergarment useful for describing embodiments of the present disclosure.

It is to be understood that the figures and descriptions of the present invention have been simplified to illustrate elements that are relevant for a clear understanding of the present invention, while eliminating, for purposes of clarity, many other elements found in typical undergarments, such as brassieres. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Embodiments of the present disclosure include devices configured to be retrofitted to existing garments (e.g. brassieres) for providing additional girth adjustment, including both expansion and reduction, beyond what is provided by the garment's original (or factory) range of adjustment. Embodiments include a rigid elongated body having first and second band retaining loops arranged on respective ends thereof. Proximate one end of the body, first fasteners (e.g. hooks) are provided and configured to engage with corresponding fasteners (e.g. loops or eyes) arranged on a first back band of the garment. Proximate the opposite end of the body, second fasteners (e.g. eyes or loops) are provided for engaging with fasteners (e.g. hooks) arranged on a second back band of the garment. The first and second fasteners (e.g. the hooks and eyes) of the device are positioned on the body such that the attachment point of the first and second back bands of the garment is offset or relocate beyond a position which is achievable by connecting the first and second back bands together directly.

Figure 2:
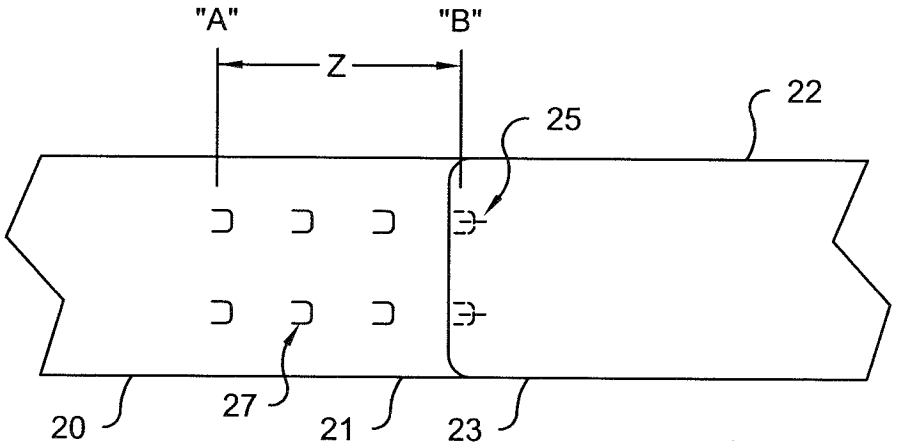
Fig. 2 (Prior Art)
FIG. 2 is an illustration of the adjustable band arrangement of the undergarment of FIG. 1.
Figure 3A:
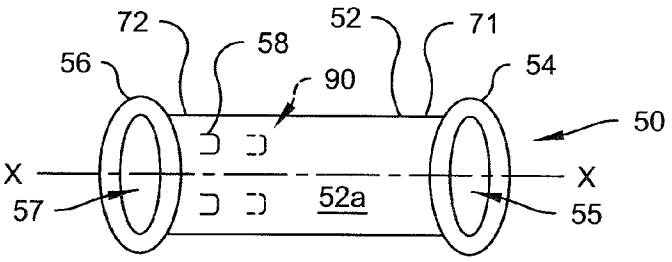
FIGS. 3A-3C illustrate a band length altering device according to an embodiment of the present disclosure.
Figure 3B:
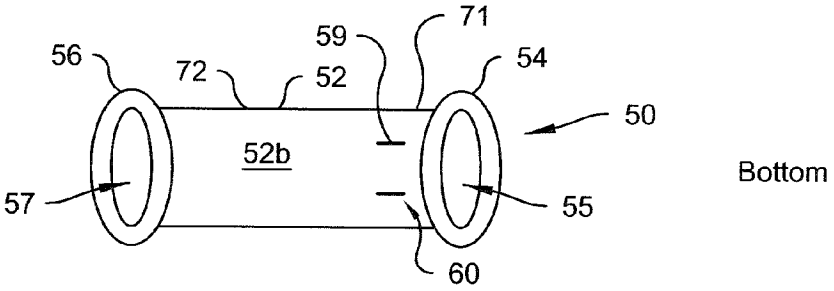
Figure 3C:
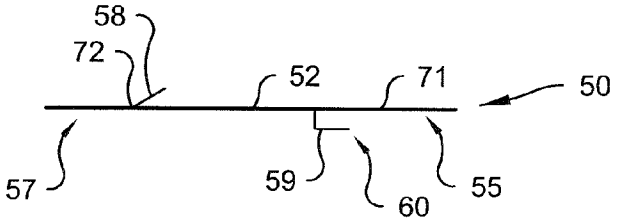

A first embodiment of an undergarment band length adjusting or altering device 50 is shown in FIGS. 3A-3C. Device 50 includes a body 52. Body 52 may be a rigid member and constructed of any suitable material (e.g. metal, plastic or other polymers). In the exemplary illustrated embodiment, body 52 is generally elongated, extending in a longitudinal direction along an axis x. Arranged on respective first and second ends 71,72 of body 52 are band retaining loops 54,56. Band retaining loops 54,56 may be formed integrally (i.e. monolithically) with body 52, or may comprise separate components attached to each end 71,72 of body 52. Band retaining loops 54,56 define respective openings 55,57. Openings 55,57 are sized to accommodate the passing of back bands of an undergarment (e.g. bands 20,22 of FIGS. 1 and 2) therethrough. In the illustrated embodiment, body 52 comprises a generally planar shape, providing a low-profile, and thus discrete, arrangement when worn by a user. It should be understood, however, that body 52 may take on other profiles, such as varying degrees and directions of curvature, so as to more accurately conform to a wearer (e.g. may comprise contours generally matching the back of a wearer). Body 52 may be formed at any length suitable for providing a desired range of girth adjustment to an undergarment. In a preferred embodiment, the width of body 52 is sized so as not to exceed the width of the back bands of the undergarment. Likewise, band retaining loops 54,56 may also be formed with a profile which is generally planar with that of body 52 (as illustrated in FIG. 3C). However, in other embodiments, band retaining loops 54,56 may be contoured in any suitable manner.

Device 50 further includes at least one first fastener, embodied herein as loops or eyes 58. Eyes 58 may be arranged on a first or top side 52*a* of body 52 (FIG. 3A), or on a like-side of band retaining loop 56. In the illustrated embodiment, eyes 58 are arranged proximate second end 72 of body 52, and have a closed end oriented in a direction generally toward first end 71 of body 52. Each eye 58 is configured to selectively engage with a complementary fastener, such as a hook or hook-like fastener, of the undergarment. It should be understood that eyes 58 may be substantially the same in form and/or function as the loops or eyes typically found in adjustable undergarment back band fastening arrangements (e.g. eyes 27 of FIGS. 1 and 2).

While the at least one first fastener is described as an eye or a loop, these fasteners may take on any suitable form without departing from the scope of the present disclosure. Moreover, while a single row comprising two eyes 58 is shown, it should be understood that embodiments of the present disclosure may comprise any number of eyes in a given row, as well as any number of additional rows of eyes 90 (FIG. 3A). The number of eyes in a given row may be varied to match standard or common brassiere back band configurations having, for example, two, three, or four fasteners in a given row. Additional rows of eyes 90 provide embodiments of the present disclosure with additional girth adjustment.

Arranged on a second or bottom side 52*b* of body 52 (FIG. 3B), opposite the first side, is at least one second fastener, embodied herein as hooks 59. As illustrated, hooks 59 are arranged proximate first end 71 of body 52 and include a free end 60 oriented in a direction toward first end 71 of body 52. Hooks 59 may be substantially the same in form and/or function as hooks 25 set forth above. Moreover, as with eyes 58, any number of hooks may be present in a given row, as well as any number of rows of hooks provided, without departing from the scope of the present disclosure. Hooks 59 may also be arranged on band retain loop 54, rather than on the elongated portion of body 52, without departing from the scope of the present disclosure.

Figure 4A:
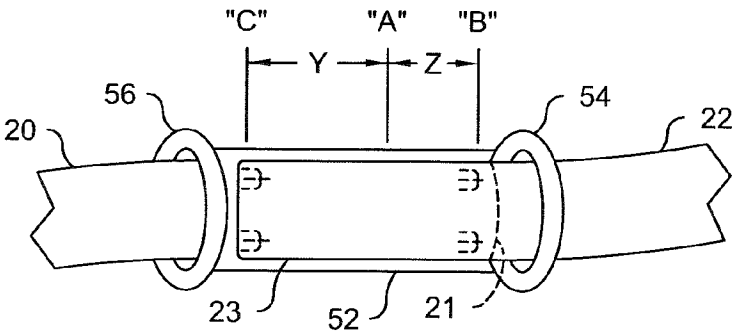
FIGS. 4A-4C illustrate the function of the band length altering device of FIGS. 3A-3C.
Figure 4B:
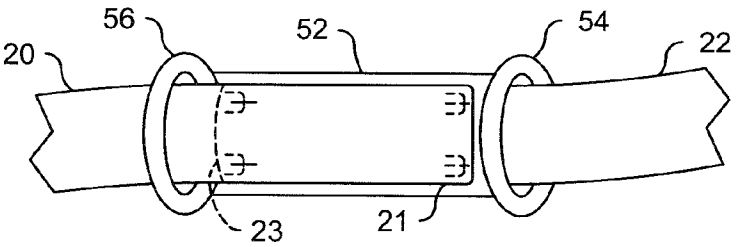
Figure 4C:
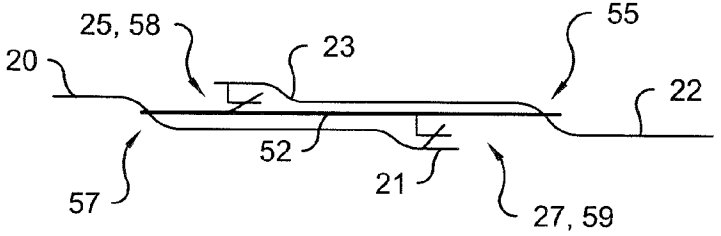

FIGS. 4A-4C illustrate an undergarment girth-reducing function of device 50 described with respect to FIGS. 3A-3C. In particular, device 50 may be retrofitted to an existing undergarment and used to reduce its overall girth beyond the girth adjustment range of the existing back band assembly (e.g. beyond range Z as illustrated with respect to FIG. 2). As illustrated, band 20 of the undergarment may be inserted through opening 57 of loop 56 of device 50 (i.e. from the first or top side of body 52 to the second or bottom side). Once inserted, eyes 27 arranged on end 21 of band 20 may be fastened to hooks 59 of device 50. Similarly, band 22 may be inserted through opening 55 of loop 54 (i.e. from the second or bottom side of body 52 to the first or top side). Hooks 25 arranged on end 23 of band 22 may be fastened to eyes 58 of device 50. Inserting bands 20,22 through the respective loops 56,54 of device 50 ensures that bands 20,22 remain in alignment with one another, and with device 50, thereby providing increased stability to the arrangement.

As shown, device 50 is operative to effectively reposition or offset the attachment point of hooks 25 of band 22 to a new position C, such that an increase Y in girth reduction over the existing range Z is realized via the overlapping of a portion of the lengths of bands 20,22. It is envisioned that the increase in girth Y achievable by device 50 may be varied in any number of ways. For example, embodiments of device 50 may be produced in several sizes, wherein at least one segment of body 52 is varied in length and/or the position of one or more of eyes 58 and hooks 59 is varied with respect to the body.

Figure 5A:
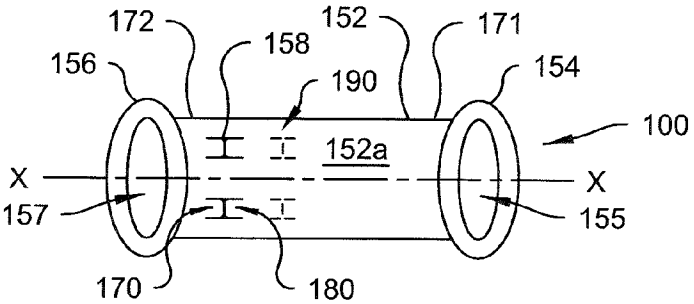
FIGS. 5A-5C illustrate a band length altering device according to another embodiment of the present disclosure.
Figure 5B:
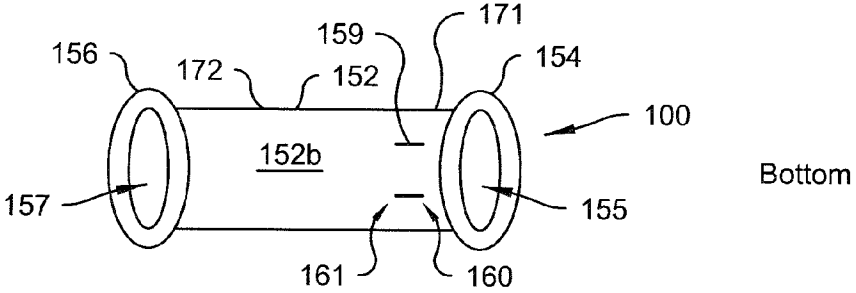
Figure 5C:
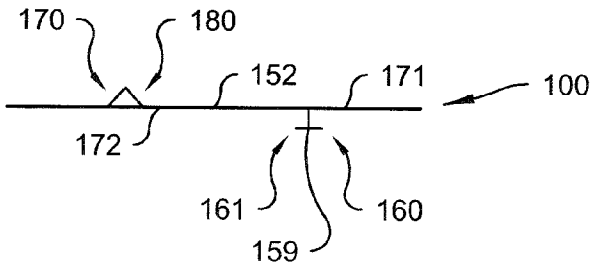

A second embodiment of an undergarment band length adjusting or altering device 100 is shown in FIGS. 5A-5C. Device 100 includes a body 152 similar to that of body 52 described above with respect to FIGS. 3A-3C. Specifically, body 152 may constructed of any suitably rigid material (e.g. metal, plastic or other polymers). Body 152 is shaped such that it extends in a longitudinal direction along an axis x. Arranged on each end 171,172 of body 152 are respective loops 154,156. Loops 154,156 may be formed integrally with body 152, or may comprise separate components attached to each end of body 152. Loops 154,156 define respective openings 155,157 which are sized to accommodate the bands of an undergarment (e.g. bands 20,22 of FIGS. 1 and 2) passing therethrough. As described above with respect to body 52 of FIGS. 3A-3C, body 152 comprises a generally planar shape, providing a low-profile, and thus discrete, arrangement when worn by a user. However, body 152 may take on other profiles, such as varying degrees and directions of curvature, so as to more accurately conform to a wearer. Body 152 may be formed at any length suitable for providing a desired range of girth adjustment to an undergarment. In a preferred embodiment, the width of body 152 is sized so as not to exceed the width of the back bands of the undergarment. Likewise, band retaining loops 154,156 may also be formed with a profile which is generally planar with that of body 152 (as illustrated in FIG. 5C). However, in other embodiments, band retaining loops 154, 156 may be contoured in any suitable manner.

Device 100 further includes first fasteners, embodied herein as loops or eyes 158. In the illustrated embodiment, eyes 158 are arranged on a first or top side 152*a* and at second end 172 of body 152. Unlike eyes 58 of FIGS. 3A-3C (i.e. eyes having a closed end oriented generally toward an a second end 72 of body 52), each eye 158 may comprise the equivalent of two opposing eyes (i.e. first and second generally u-shaped eyes having respective openings 170,180 extending toward both first and second ends 171,172 of body 152). Each of the indicated eyes 158 may be formed as a single unit, or may comprise two discrete eyes arranged opposing one another (i.e. having abutting closed ends) forming the illustrated "H" shape. In one embodiment, free ends of each side of eye 158 may be embedded within body 152. In another embodiment, each eye 158 may comprise a single opening (i.e. a single eye) and may be oriented generally vertically. It should be understood that eyes 158 may be similar in form and/or function as the loops or eyes typically found on an adjustable band assembly of an undergarment. However, in the illustrated embodiment, each eye 158 is configured to receive and attach to a corresponding hook element inserted therethrough from either direction (i.e. from either axial direction generally along axis x).

As set forth above with respect to device 50, while a single row of two eyes 158 are shown, embodiments of the present disclosure may comprise any number of eyes in a given row in order to correspond to an existing number of fasteners of an undergarment. Embodiments may also comprise any number of additional rows of eyes 190 for providing additional girth adjustment.

Arranged on a side of body 152 opposite eyes 158 (i.e. on a bottom side 152*b* of body 152, FIG. 5B) are second fasteners, embodied as hooks 159. As illustrated, each hook 159 includes two free ends 160,161 oriented in opposing directions toward the first and second ends 171,172 of body 152, respectively. As each hook 159 comprises two free ends, they may engage with a corresponding loop or eye of an undergarment band when device 100 is oriented two distinct directions (i.e. along either axial direction), as will be set forth with respect to FIGS. 6A-7B. Hooks 159, or each half of each hook 159, may be substantially the same in form and/or function as hooks 25 set forth above. Moreover, as with eyes 158, any number of hooks 159 may be present in a given row, as well as any number of rows of hooks provided, according to embodiments of the present disclosure.

Figure 6A:
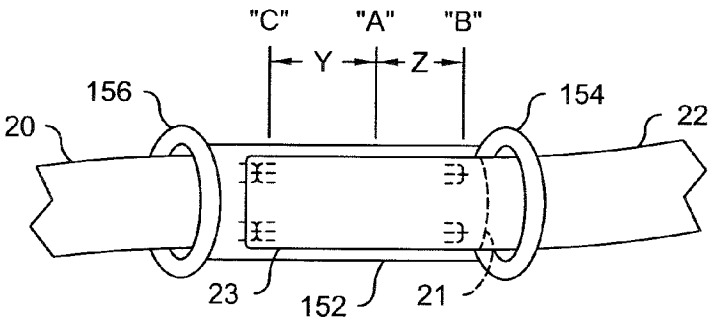
FIGS. 6A-6C illustrate a first function of the band length altering device of FIGS. 5A-5C.
Figure 6B:
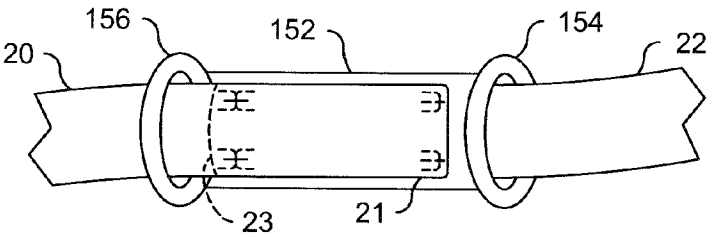
Figure 6C:
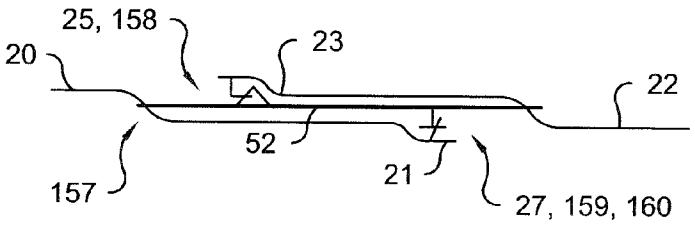

FIGS. 6A-6C illustrate an undergarment girth reduction function of device 100 described with respect to FIGS. 5A-5C. As shown, device 100 functions in substantially the same manner as device 50 illustrated in FIGS. 3A-4C. In particular, device 100 may be used to reduce the girth of an undergarment (e.g. undergarment 10 of FIGS. 1 and 2) beyond the typical girth adjustment range Z as illustrated with respect to FIG. 2. Band 20 of the undergarment may be inserted through opening 157 of loop 156 (i.e. from a top side thereof to a bottom side). Eyes 27 arranged on end 21 of band 20 may be fastened over free ends 160 of hooks 159 of device 100. Similarly, band 22 may be inserted through opening 155 of loop 154 (i.e. from a bottom side thereof to a top side). End 23 of band 22 may be secured to a first side of eyes 158 of device 100 at a new position C via hooks 25 arranged thereon. As set forth above with respect to FIGS. 4A-4C, an increase Y in the available girth reduction is realized over the original range Z.

Figure 7A:
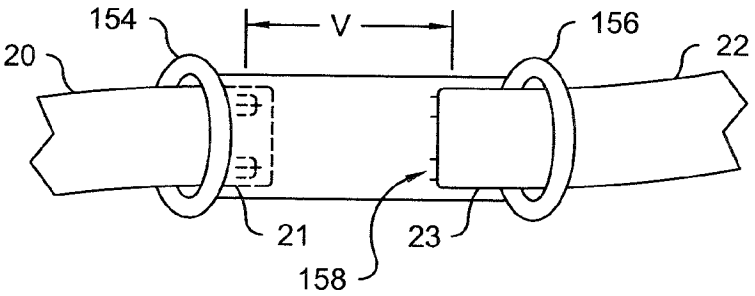
FIGS. 7A-7C illustrate a second function of the band length altering device of FIGS. 5A-5C.
Figure 7B:
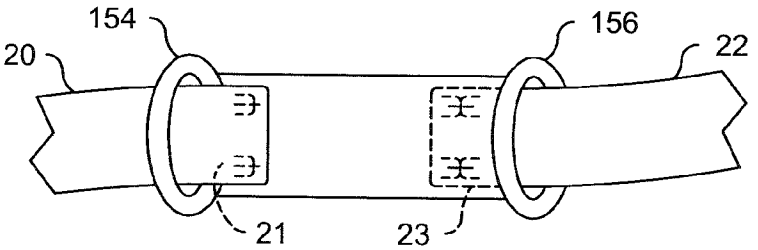
Figure 7C:
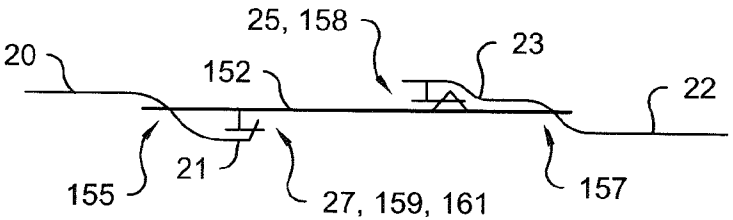

In addition to the above-described girth reduction function, device 100 is further configured to perform a girth increase or expansion function, as illustrated in FIGS. 7A-7C. As shown, device 100 has been reoriented (i.e. rotated 180 degrees in the axial direction) with respect to bands 20,22 from the position illustrated in FIGS. 6A-6C in order to expand the girth of an undergarment beyond its original maximum girth (i.e. position B). As illustrated, band 20 of the undergarment may be inserted through opening 155 of loop 154 (i.e. from a top side thereof to a bottom side). Eyes 27 arranged on end 21 of band 20 may be fastened over free ends 161 of hooks 159 of device 100. Similarly, band 22 of the undergarment may be inserted through opening 157 of loop 156 (i.e. from a bottom side thereof to a top side). Hooks 25 arranged on end 23 of band 22 may be secured to a second side of eyes 158 of device 100. Once secured, a total girth increase of V is realized over the maximum girth position achievable by the existing hook and loop fastener arrangement. In this way, device 100 functions as an intermediate point of connection for both band 20 and band 22 of the undergarment.

A shown, the embodiment of FIGS. 5A-5C provides a single device that performs both girth reduction and girth expansion functions depending on its orientation. As with the embodiment of FIGS. 3A-3C, it is envisioned that embodiments device 100 may be manufactured in several sizes (i.e. varying body lengths), and may include various hook and eye configurations for matching a variety of undergarment configurations.

While embodiments of the present disclosure are described in the context of altering the length (and thus the girth) of an undergarment, it should be understood that embodiments may be used to alter the length of any other type of band assembly which includes the use of multiple elements (e.g. bands) detachably connectable to one another via fasteners, without departing from the scope of the present disclosure.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A device configured to alter a circumferential length of an undergarment band assembly including a first band having a first band fastener and a second band having a second band fastener for detachably connecting the first band to the second band about a circumference of a wearer's torso or appendage, comprising:

an elongated body including:

a first band retaining loop arranged at a first end of the body; and a second band retaining loop arranged at a second end of the body, a first fastening element arranged proximate the first end of the body and configured to engage with the second band fastener of the second band; and a second fastening element arranged proximate the second end of the body and configured to engage with the first band fastener of the first band.

2. The device of claim 1, wherein the second fastening element is configured to detachably connect to the first band fastener of the first band when the first band is inserted through the first band retaining loop, and the device is oriented in a first orientation with respect to the first band.

3. The device of claim 2, wherein the first fastening element is configured to detachably connect to the second band fastener of the second band when the second band is inserted through the second band retaining loop, and the device is oriented in the first orientation with respect to the first band.

4. The device of claim 3, wherein the second fastening element is configured to detachably connect to the first band fastener of the first band when the first band is inserted through the second band retaining loop, and the device is oriented in a second orientation, different from the first orientation, with respect to the first band.

5. The device of claim 4, wherein the first fastening element is configured to detachably connect to the second band fastener of the second band when the second band is inserted through the first band retaining loop, and the device is oriented in the second orientation with respect to the first band.

6. The device of claim 5, wherein the first fastening element comprises an eye defining an opening.

7. The device of claim 6, wherein the second fastening element comprises a hook having a first free end.

8. The device of claim 7, wherein the hook is oriented such that the first free end thereof extends in a direction toward the second end of the body.

9. The device of claim 8, wherein the hook comprises a second free end extending in a direction toward the first end of the body.

10. The device of claim 9, wherein the first band fastener of the first band comprises an eye configured to accept one of the first or second free ends of the hook.

11. The device of claim 1, wherein the elongated body comprises a rigid body.

12. The device of claim 1, wherein the first fastening element is arranged on a first side of the body.

13. The device of claim 12, wherein the second fastening element is arranged on a second side of the body, opposite the first side of the body.

14. A method of connecting a first band of an undergarment to a second band of the undergarment with a device for altering the girth of the undergarment to encircle a portion of a wearer's body, comprising:

inserting the first band of the undergarment through one of a first or a second band retaining loop arranged on the device;

attaching a first fastener of the first band to a second fastening element arranged proximate a second end of the device;

inserting the second band of the undergarment through the other one of the first or the second band retaining loop arranged on the device;

attaching a second fastener of the second band to a first fastening element arranged proximate a first end of the device, thereby altering the circumferential length of the undergarment.

15. The method of claim 14, wherein the first band retaining loop is arranged on a first end of the device, and the second band retaining loop is arranged on a second end of the device, and wherein the girth of the undergarment is reduced by:

inserting the first band of the undergarment through the first band retaining loop when the device is oriented in a first orientation with respect to the first band, and inserting the second band of the undergarment through the second band retaining loop when the device is oriented in the first orientation with respect to the first band.

16. The method of claim 15, wherein the girth of the undergarment is increased by:

inserting the first band of the undergarment through the second band retaining loop when the device is oriented in a second orientation with respect to the first band, the second orientation different from the first orientation, and inserting the second band of the undergarment through the first band retaining loop when the device is oriented in the second orientation with respect to the first band.

17. The method of claim 14, wherein the first fastening element is arranged on a first side of the device, and the second fastening element is arranged on a second side of the device, the second side of the device being opposite the first side.

18. The device of claim 1, wherein the elongated body is an elongated planar body, and wherein the first and second band retaining loops are configured to be planar with the elongated planar body.

19. The method of claim 14, wherein the device has a planar shape.

20. The device of claim 1, wherein the undergarment band assembly is a brassiere having shoulder straps connected to corresponding cup assemblies.

* * * * *